US005879195A

United States Patent [19]

Cheng

[11] Patent Number: 5,879,195

[45] Date of Patent: Mar. 9, 1999

[54] COMBINING STRUCTURE BETWEEN A LAMP SOCKET AND A LAMP BASE OF CHRISTMAS LIGHTS

[76] Inventor: Horng-Huei Cheng, No. 60, Lane 68, Nan-Chung Street, Hsin-Chu, Taiwan

[21] Appl. No.: 898,262

[22] Filed: Jul. 22, 1997

[51] Int. Cl.[6] ..... H01R 17/00

[52] U.S. Cl. ..... 439/619; 439/699.2

[58] Field of Search ..... 439/611–619, 699.2, 439/356

[56] References Cited

U.S. PATENT DOCUMENTS

| | | | |
|---|---|---|---|
| 5,314,348 | 5/1994 | Wu | 439/356 |
| 5,443,399 | 8/1995 | Jing et al. | 439/619 |
| 5,443,402 | 8/1995 | Huang | 439/619 X |
| 5,722,860 | 3/1998 | Pan | 439/619 |

*Primary Examiner*—Khiem Nguyen
*Attorney, Agent, or Firm*—Bucknam and Archer

[57] ABSTRACT

A lamp base having upper and lower ends and a recess hole being provided on said upper end downward for receiving a lamp bulb which has two lead wires threading through out of the two sides of said lower end; and a lamp socket having upper and lower ends and an inner through hole to receive said lamp base, two power sources wires being inserted into said through hole from said lower end thereof to connect respectively with two contact plates fixed on the inner opposite walls of said through hole for making contact with said lead wires of said lamp bulb, characterized in that said lamp base has an end of a long friction stub connected on the lower end surface thereof, while another end of the friction stub is a free end, and in said through hole of said lamp socket, two inner side walls having no contact plates, form a recess on each said inner wall and these two recesses surrounding a space which has a sectional shape to be tightly fitted with that of said friction stub, when said friction stub plugs into the space surrounded by said two recesses, said another end of said friction stub can extend out of the lower end surface of said lamp socket.

17 Claims, 8 Drawing Sheets

COMBINING STRUCTURE BETWEEN A LAMP SOCKET AND A LAMP BASE OF CHRISTMAS LIGHTS

BACKGROUND OF THE INVENTION

1. Field of the Invention

The present invention relates to a combining structure between a lamp socket and a lamp base of Christmas lights for improving the stable combination between the lamp socket and the lamp base.

2. Description of the Related Art

A conventional Christmas light generally comprises of a lamp bulb, a lamp base and a lamp socket, therein the lamp base is first combined together with the lamp bulb and then inserted into the lamp socket so as to maintain the combined relationship between the lamp base and the lamp socket by the friction force between their surfaces. However, in a case that the lamp base and the lamp socket are made of the recycled plastic materials, it is difficult to control the dimensional tolerance of tight fit between them; therefore, it results a very unstable friction force. Often, there are defeats either too tight or too loose between the lamp base and the lamp socket. If it is too loose, they are easy to be dislodged from each other and the contact resistance becomes high enough to cause a latent hazard of fire. On the contrary, if it is too tight, it will affect the assembling speed and thereafter the advantages of replacing burned out lamps.

In view of the fact that the existing structure between the conventional lamp base and lamp socket is controlled by the dimensional tolerance, it is difficult to achieve tight fit because the materials used in every batch are different. Furthermore, due to the purpose of reducing the production costs, the plastic materials generally used are recycled materials, of which the quality is variable, so as to cause the appropriate friction force obtained from the controlling dimensional tolerance becomes meaningless.

Therefore, the object of the present invention is to provide an innovated structure between a lamp socket and a lamp base of Christmas lights for supporting a stable combination between them.

According to the present invention, the lamp base is integrally formed at its end a long friction stub which has an expanded forehead, and the lamp socket is formed at its end inserted with lead wires a positioning hole. When the lamp base and the lamp socket are combined together, it is required to first make the friction stub positioned toward the positioning hole, then it is easy and convenient to press the lamp base and the lamp socket together owing to the fitness between the two elements. Due to the frictional force between the expanded end of the friction stub and the positioning hole, it can be assured that the stable condition between them will be sustained without being affected by external nature forces or other factors after assembled. On the other hand, if the lamp base and the lamp socket have to be separated, it is only necessary to push on the fore end of the friction stub which is exposed out of the lamp socket, to make the lamp base slightly dislodged from the lamp socket, thus it is easy to apply a force on the lamp base to extract it out of the lamp socket for replacing a new lamp base.

It is therefore another object of the present invention to provide, in addition to the stable combining relationship resulted between the lamp socket and the lamp base, a lamp socket and a lamp base which can be slightly separated from each other for easily applying a force on the lamp base.

It is yet another object of the present invention, in which the structure, according to the present invention, can be applied to the stable combination between a conglomeration of twin or multiple lamp bases and a corresponding shaped conglomeration of lamp sockets, subsequently to solve the defeats of not easily connected to each other due to the dimensional interference between each lamp base and the correspondent lamp socket of the combination of the conventional multiple lamp bases and multiple lamp sockets.

It is yet further another object of the present invention to provide a combining structure of multiple twin lamp bases and multiple lamp sockets, in which two vertical grooves are respectively formed in the middle portions of two outer surface of the multiple lamp sockets, and an additional inverted U shaped clip made of plastic has a lobe on each of the tips of its two branch legs. Thus, by using the present invention, after the twin lamp bases and the twin lamp sockets are pressed together, the inverted U shaped clip can bridge across the middle portion of the two lamp bases to make the lobes of the two branch legs sliding along the vertical grooves on the two outer surface of the lamp sockets until they arrive at the bottom of the lamp sockets. Then the separated branch legs come to close again, so that the two lobes are attached against the bottom surface of the lamp sockets and the lamp bases and the lamp sockets are tightly combined together by this inverted U shaped clip. On the other hand, such two lobes can be pull off the bottom surface of the lamp sockets and dismounted from the lamp bases and lamp sockets, then the lamp bases can be pull out from the lamp sockets by an appropriate force.

The above mentioned objects, other objects and advantages of the present invention will be further apparent from the following detailed description of the present invention with the preferred embodiments taking in conjunction with the accompanying drawings.

DETAILED DESCRIPTION OF THE PREFERRED EMBODIMENTS

Figure 1:
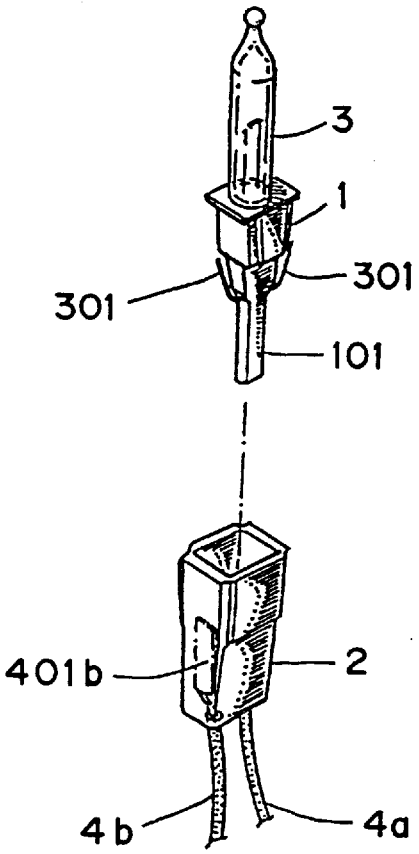
FIG. 1 is an exploded oblique view illustrating the combining structure of a lamp base and a lamp socket of a first embodiment according to the present invention.
Figure 2:
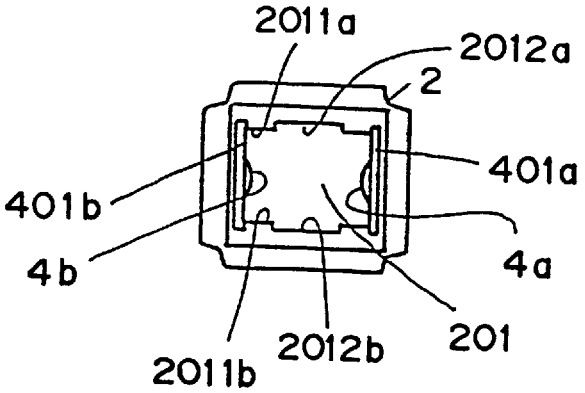
FIG. 2 is a top view of the lamp socket in FIG. 1.
Figure 3:
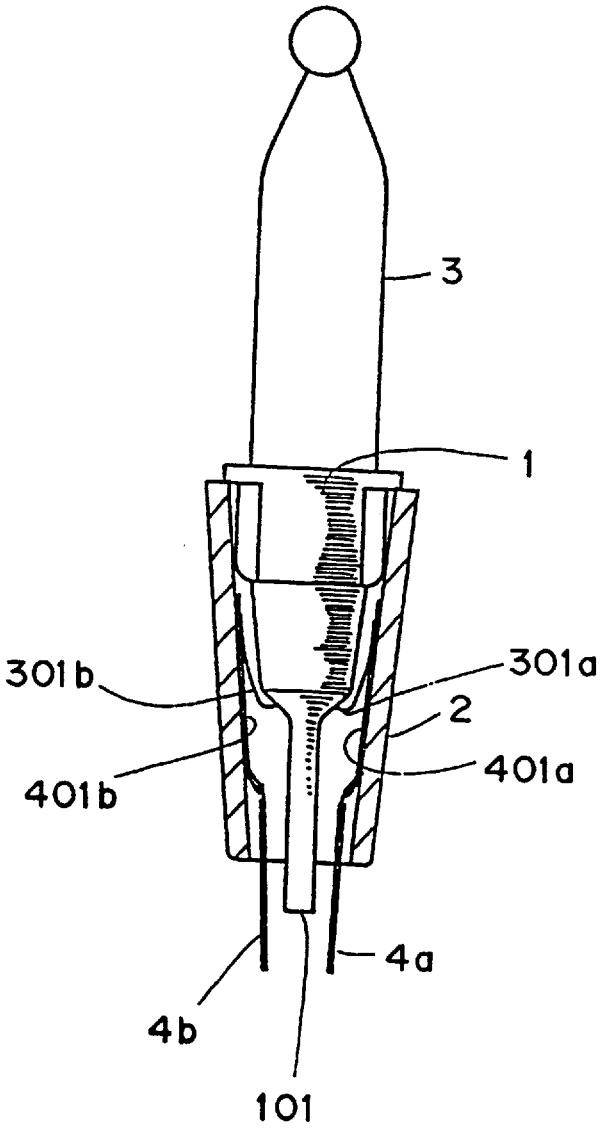
FIG. 3 is a front sectional view of the lamp base and the lamp socket combined together shown in FIG. 1.

First, refer to FIG. 1, 2 and 3, the present invention provides a long friction stub 101 formed integrally on the end of a conventional lamp base 1. Further, a lamp socket 2 matched with the lamp base 1 has an inner hole 201, in which upper and lower side walls (as seen in FIG. 2) 2011*a*, 2011*b* are formed with an upper recess 2012*a* and a lower recess 2012*b* respectively to conform the outer shape of the friction stub 101. These two opposite recesses have wider spacing between then on the top edge than that of the lower edge and are in slant forms. A Christmas lamp bulb 3 is inserted into the lamp base 1 from the opening end thereof, while two lead wires 301*a*, 301*b* of the lamp bulb extend out from the bottom end of the lamp base and bend over along the side walls of the lamp base toward the top. The lamp socket is also made of plastic materials and has power supply wires 4*a*, 4*b* inserted from bottom of the inner hole 201 and connected to contact tabs 401*a*, 401*b* by their ends respectively. The tabs are respectively attached on both side walls of the inner hole. When the lamp base 1 is inserted into the inner hole 201 of the lamp socket 2 from top opening, the lead wires 301*a*, 301*b* of the lamp bulb are pressed against the contact tabs 401*a*, 401*b* to be electrical connected. The manufacture and assembly method of the associated lamp bulb, lamp base and lamp socket are all conventionally known arts.

According to the present invention, when the lamp base 1 is inserted into the inner hole 201 of the lamp socket 2 and positioned therein, the friction stub 101 is inserted into the space between the upper and lower recesses 2012*a*, 2012*b* of inner hole 201 of the lamp socket 2. Owing to the outer profile of the front end of the friction stub 101 can be made larger than the corresponding opening formed by the upper and lower recesses, so that the friction stub 101 is tightly plunged into and between the upper and the lower recesses and maintain the lamp base in the lamp socket immovable. On the other hand, because the friction stub 101 is extended out the bottom end of the lamp socket 2, in removing the lamp base 1 from the lamp socket 2, it is only necessary to apply force on the tip end of the friction stub 101 to make the lamp base I raised a level fiom the lamp socket 2. Then, it is convenient to extract out the lamp base from the lamp socket by figures with a little pulling force.

Figure 4:
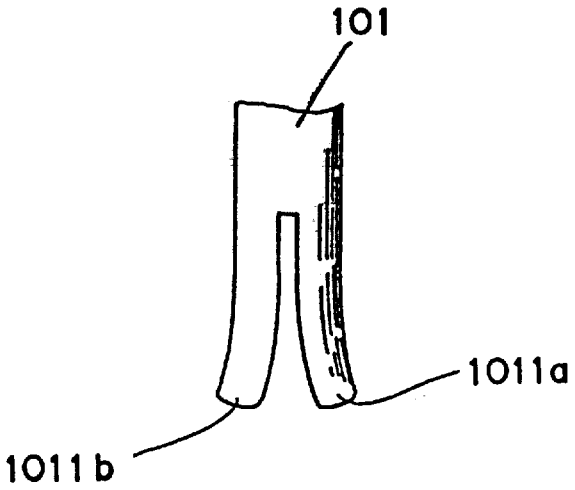
FIG. 4 is a second configuration of the end of the friction stub on the lamp base shown in FIG. 1.

FIG. 4 illustrates a second configuration of the front end of the friction stub which splits into two branch legs 1011*a*, 1011*b* as a form of fork separated toward outwards. Thus, these two branch legs 1011*a*, 1011*b* slid in the slant upper and lower recesses are compressed toward each other and again spring outward when they come out of the lamp socket 2, so as to additionally increase the combining force. On the other hand, when it is desirable to separate the lamp base and the lamp socket, these two branch legs 1011*a*, 1011*b* can be forced toward center by two fingers and push them up, then the lamp base can be pull out from the lamp socket by the same method described as above.

Figure 5:
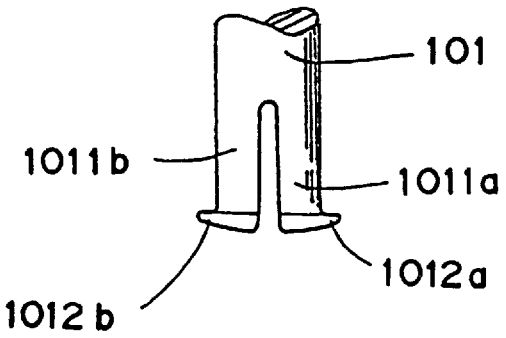
FIG. 5 is a third configuration of the end of the friction stub on the lamp base shown in FIG. 1.

FIG. 5 is a third configuration of the front end of the friction stub 101 which is different from the front end of the friction stub in FIG. 4, in that the two branch legs 1011*a*, 1011*b* form integrally and respectively at their ends a lobe 1012*a*, 1012*b* extended outward horizontally. When the front end of the friction stub extended out of the bottom of the lamp socket, these two lobes 1012*a*, 1012*b* can attach against the bottom side of the lamp socket.

The friction stub 101 described above in FIG. 1 is shown as a square stub for exemplify purpose. However, in the present invention, it is not limited to a square shape, but circular shape, elliptical shape, polygonal shape, and the like are all can be applied.

Figure 6:
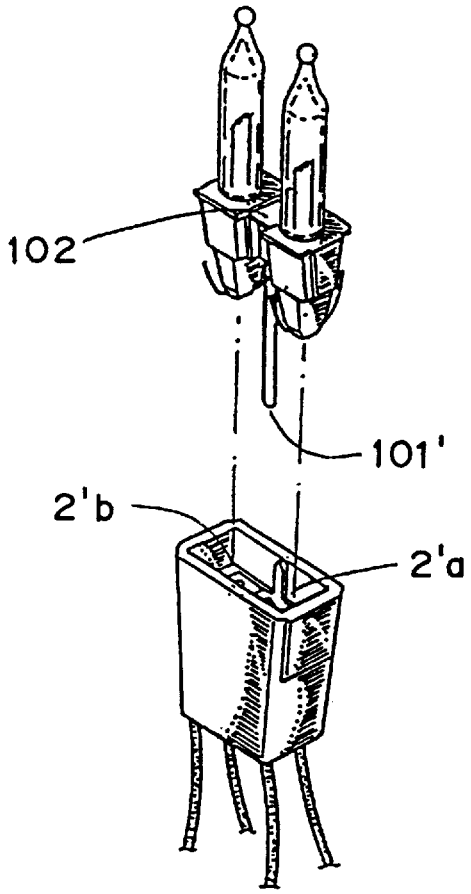
FIG. 6 is an exploded oblique view illustrating an embodiment of structure used in multiple twin lamp bases and multiple twin lamp sockets before combined together according to the present invention.
Figure 7:
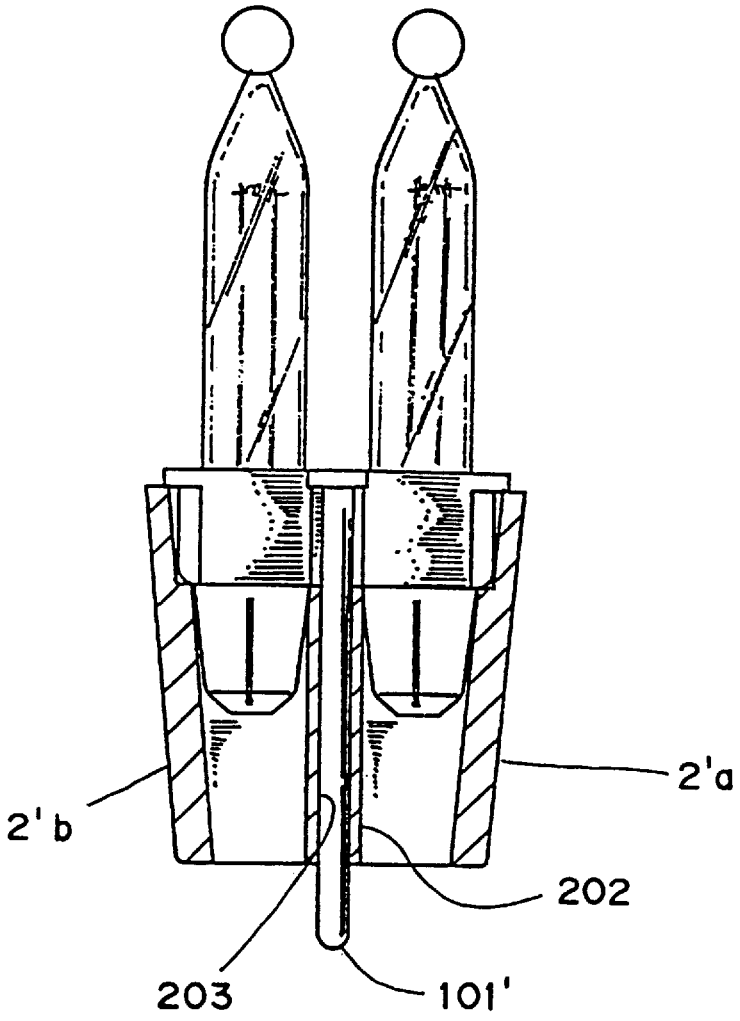
FIG. 7 is a front sectional view illustrating a combining structure of the multiple twin lamp bases and lamp sockets shown in FIG. 6.

FIG. 6 and 7 show an embodiment of multiple twin lamp bases and multiple twin lamp sockets, which is an application of the present invention. Wherein two same types of single lamp base are connected together by a connecting strip 102 and a friction stub 101' is connected to the lower surface of the connecting strip 102. Two conventional structured lamp sockets 2'*a*, 2'*b* are also connected together, but between the neighboring walls 202 of these two lamp sockets (referring to FIG. 7) there is a positioning hole 203 which has a form corresponding to the sectional form of the friction stub 101'. Thus when the multiple twin lamp bases are inserted into the multiple twin lamp sockets, the friction stub 101' is inserted into the positioning hole 203 to make both connected together as shown in FIG. 7. As to a configuration with more than two lamp bases connected together and corresponding form of more than two lamp sockets connected together can also be completely connected by using such a like structure to achieve the connection. It will be not described further herein.

Figure 8:
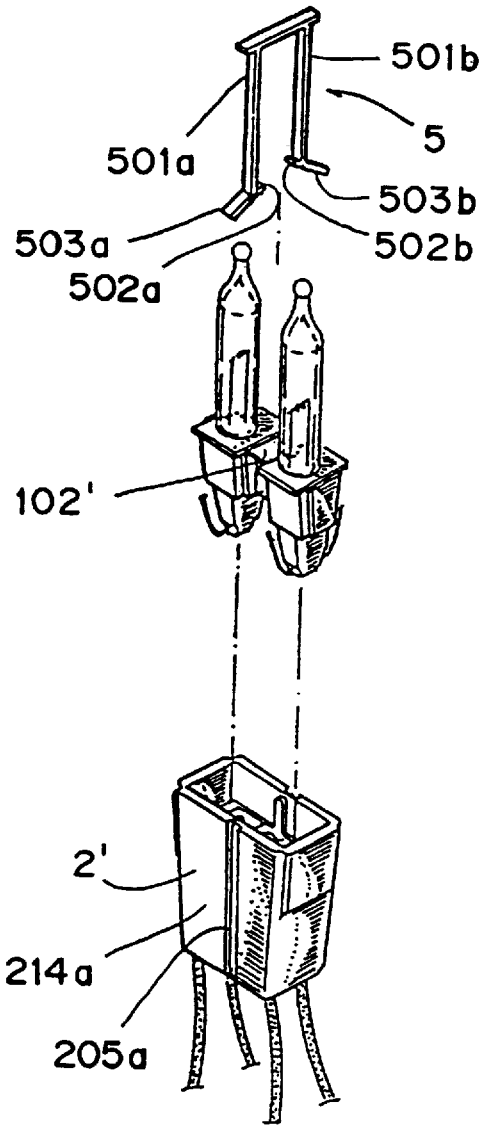
FIG. 8 is an exploded oblique view illustrating a second embodiment of combining structure of multiple twin lamp bases and a multiple twin lamp sockets before combined together according to the present invention.

FIG. 8 shows a second embodiment of the combining structure of multiple twin lamp bases and multiple twin lamp sockets, therein the two single lamp bases are connected together by a connecting strip 102' and the multiple twin lamp socket has two positioning grooves 501*a*, 501*b* formed along through the axis direction respectively on the middle portions of the surface of two outer walls 204*a*, 204*b*. In addition, there is an inverted U shaped clip 5 which has two branch legs 501*a*, 501*b* with a width corresponding to that of the positioning grooves 204*a*, 204*b*. The inner spacing between the two opposite branch legs is corresponding to the thickness between the bottom ends of the two positioning grooves, so that the two branch legs of the inverted U shaped clip can bridge across on the two positioning grooves. Further, two projecting lobes 502*a*, 502*b* opposed to each other are formed at the ends of the two branch legs. On the other side of the projecting lobe 502*a*, 502*b*, it also forms a pawl 503*a*, 503*b* extending outward.

According to the present invention, after the multiple twin lamp bases are plugged into the corresponding lamp sockets, The inverted U shaped clip 5 can bridge on the top of the connecting strip 102' of the twin lamp sockets, and pressed down with its two branch legs along the corresponding positioning grooves respectively. Thus, when the clip 5 presses on the upper surface of the connecting strip 102', the two projecting lobes 502*a*, 502*b* of the clip can be pressed against the bottom surface of the lamp sockets to restrict the lamp base from disengaging the lamp socket. On the other hand, when the lamp base is required to be extracted out from the lamp socket, it is only necessary to force the two branch legs of the inverted U shaped clip separated by oppositely pulling the two pawls 503*a*, 503*b* outward and pushed upward. Therefore, it releases the clipping force between the lamp bases and the lamp sockets and the lamp bases can be easily extracted out from the lamp sockets. It should be noted that the twin lamp bases and the twin lamp sockets are used merely for description. However, the present invention can also be applied to the multiple combination of more than two lamp bases and two lamp sockets.

Figure 9:
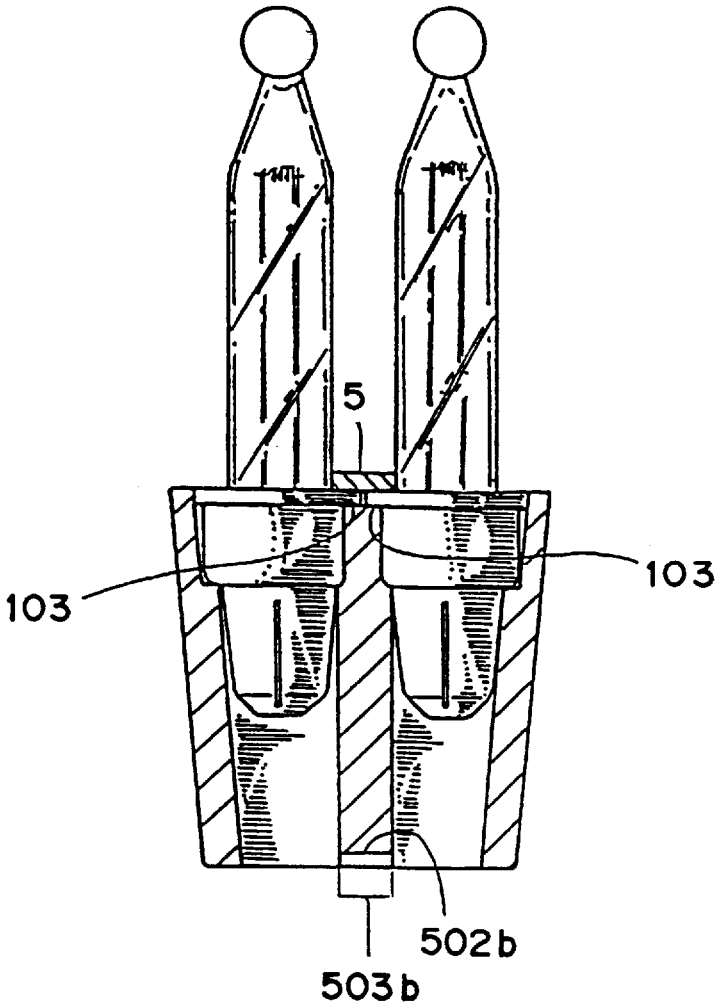
FIG. 9 is a front sectional view similar to the case of FIG. 8 except that the two lamp bases are not connected together.

FIG. 9 is identical to FIG. 8 in using the inverted U shaped clip performing the joint of the lamp bases and the lamp sockets, but the difference of FIG. 9 to FIG. 8 is that two lamp bases are independent with each other without joining together. As shown in FIG. 9 the combining structure has the inverted U shaped clip S pressed on the flanges 103 of the lamp bases. Therefore, the lamp bases and the lamp sockets can be clipped and held together.

In summing up, the combining structure of the lamp bases and the lamp sockets using and provided by the present invention can make the combination more secure thereof without hindering their separation thereafter. It is indeed a valuable invention with practical application.

I claim:

1. A combining structure between a lamp socket and a lamp base of Christmas lights, comprising:

a lamp base having upper and lower ends and a recess hole being provided on said upper end downward for receiving a lamp bulb which has two lead wires threading through out of the two sides of said lower end; and a lamp socket having upper and lower ends and an inner through hole to receive said lamp base, two power sources wires being inserted into said through hole from said lower end thereof to connect respectively with two contact plates fixed on the inner opposite walls of said through hole for making contact with said lead wires of said lamp bulb, characterized in that said lamp base has an end of a long friction stub connected on the lower end thereof, while another end of the friction stub is a free end which is bifurcated to form two separated branch legs, and in said through hole of said lamp socket, two inner side walls having no contact plates, each forms a recess on said inner wall and these two recesses surrounding a space which has a sectional shape to be tightly fitted with that of the branch legs of said bifurcated friction stub, when said friction stub plugs into the space surrounded by said two recesses, said another end of said friction stub can extend out of the lower end of said lamp socket.

2. The combining structure between a lamp socket and a lamp base of Christmas lights according to claim 1, wherein said friction stub is a rectangular stub.

3. The combining structure between a lamp socket and a lamp base of Christmas lights according to claim 1, wherein said friction stub is a circular stub.

4. The combining structure between a lamp socket and a lamp base of Christmas lights according to claim 1, wherein said friction stub is an elliptical stub.

5. The combining structure between a lamp socket and a lamp base of Christmas lights according to claim 1, wherein said friction stub is a polygonal stub.

6. The combining structure between a lamp socket and a lamp base of Christmas lights according to claim 1, wherein said free end of said friction stub is formed with a cross sectional area slightly larger than the sectional area of the space surrounded by two recesses near the lower end of said lamp socket.

7. The combined structure between a lamp socket and a lamp base of Christmas lights according to claim 1, wherein two ends of said separated branch legs on the free end of said friction stub form two lobes oppositely facing each other.

8. A combining structure between lamp sockets and lamp bases of Christmas lights, comprising:

multiple interconnected lamp bases and interconnected lamp sockets, each lamp base having upper and lower ends and a recess hole being provided on the upper end downward for receiving a lamp bulb which has two lead wires threading through out of the two sides of said lower end; and each lamp socket having upper and lower ends and an inner through hole to receive said lamp base, two power sources wires being inserted into said through hole from said lower end thereof to connect respectively with two contact plates fixed on the inner opposite walls of said through hole for making contact with said lead wires of said lamp bulb plugged in said through hole, characterized in that said lamp bases are interconnected to each other by connecting strips having bottom surfaces, at least one of the bottom surfaces of said connecting strips connecting to an end of a long friction stub, while another end of said friction stub being a free end, and a positioning hole is formed between two neighboring said lamp sockets and has a sectional shape corresponding to the sectional shape of said friction stub, when said interconnected lamp bases are inserted into the corresponding said interconnected lamp sockets, said friction stub is tightly fitted with said positioning hole.

9. The combining structure between lamp sockets and lamp bases of Christmas lights according to claim 8, wherein said friction stub is a rectangular stub.

10. The combining structure between lamp sockets and lamp bases of Christmas lights according to claim 8, wherein said friction stub is a circular stub.

11. The combining structure between lamp sockets and lamp bases of Christmas lights according to claim 8, wherein said friction stub is an elliptical stub.

12. The combining structure between lamp sockets and lamp bases of Christmas lights according to claim 8, wherein said friction stub is a polygonal stub.

13. The combining structure between lamp sockets and lamp bases of Christmas lights according to claim 8, wherein said free end of said friction stub is formed with a sectional area slightly larger than the sectional area of the positioning hole formed between two outside walls of the neighboring lamp sockets.

14. The combining structure between lamp sockets and lamp bases of Christmas lights according to claim 8, wherein said free end of the friction stub forms two separated branch legs.

15. The combining structure between lamp sockets and lamp bases of Christmas lights according to claim 8, wherein said two separated branch legs of said free end of said friction stub form respectively two opposite horizontal lobes facing each other at the front ends thereof.

16. A combining structure between lamp sockets and lamp bases of Christmas lights, comprising: multiple lamp bases, interconnected lamp sockets and at least an inverted U shaped clip, wherein, each said lamp base has upper and lower ends, a surrounding flange formed on said upper end, and a recess hole formed in the upper end downward for receiving a lamp bulb which has two lead wires extending out respectively from two sides of said lower end; each said lamp socket has upper and lower ends, a through hole formed inside for receiving said lamp base, and two power source wires inserted into said through hole from said lower end of said through hole to respectively connect with two contact tabs fixed on the opposite inner walls of said through hole for making contact with said lead wires of said lamp bulb plugged in each through hole; said interconnected lamp sockets has two positioning grooves formed respectively along the axial direction, on the two outer walls at the connecting location of said interconnected lamp sockets; and said inverted U shaped clip has two branch legs of which a width is corresponding to the width of said positioning groove and the tip of the free end is formed a lobe facing to another lobe and a pawl extending outward; therefore, after said lamp bases are inserted into said lamp sockets, said branch legs of said inverted U shaped clip will be used to bridge the two sides of said lamp sockets in said positioning grooves sliding downward until said lobes of said two branch legs attach the lower ends of said lamp sockets, then said inverted U shaped clip will press the flanges of said multiple lamp bases on the upper end of said lamp sockets.

17. The combining structure between lamp sockets and lamp bases of Christmas lights according to claim 16, wherein said lamp bases can also be connected together by a connecting strip at their flanges, said connecting strip is pressed on said upper end surface of said lamp socket by an inverted U shaped clip for connecting said lamp bases and said lamp sockets.

* * * * *